US005979690A

United States Patent [19]

Hartley

[11] Patent Number: 5,979,690

[45] Date of Patent: Nov. 9, 1999

[54] RECLOSABLE RECTANGULAR CONTAINER ASSEMBLY WITH TAMPER INDICATOR

[75] Inventor: Gary L. Hartley, Monroe, N.C.

[73] Assignee: Berry Plastic Corporation, Evansville, Ind.

[21] Appl. No.: 08/974,241

[22] Filed: Nov. 19, 1997

[51] Int. Cl.[6] ..... B65D 41/32

[52] U.S. Cl. ..... 220/266; 220/366.1; 220/781; 220/785; 220/787; 220/788; 220/790; 220/791; 206/508

[58] Field of Search ..... 220/780, 781, 220/789, 790, 793, FOR 100, 380, 276, 266, DIG. 34, FOR 101, 366.1, 785, 787, 788, 791; 206/508; 215/320, 256, 321

[56] References Cited

U.S. PATENT DOCUMENTS

| | | | |
|---|---|---|---|
| 1,691,394 | 11/1928 | Karl . | |
| 2,941,562 | 6/1960 | Ripin . | |
| 3,055,540 | 9/1962 | Ringlen | 220/789 |
| 3,722,731 | 3/1973 | McCormick et al. | 220/380 X |
| 3,831,798 | 8/1974 | Rowe et al. | 220/276 X |
| 3,880,288 | 4/1975 | Hunter | 220/380 X |
| 3,977,563 | 8/1976 | Holt | 220/790 X |
| 4,046,282 | 9/1977 | Ruch | 220/790 X |
| 4,113,136 | 9/1978 | Abbott | 220/276 |
| 4,212,409 | 7/1980 | Jeppsson . | |
| 4,387,818 | 6/1983 | Conti | 215/256 |
| 4,407,426 | 10/1983 | McLaren et al. | 220/380 X |
| 4,446,986 | 5/1984 | Bowen et al. | 220/789 |
| 4,465,205 | 8/1984 | Sutch | 220/276 |
| 4,488,676 | 12/1984 | Halliday . | |
| 4,518,097 | 5/1985 | Milton et al. | 206/508 X |
| 4,682,706 | 7/1987 | DeVore et al. . | |
| 4,836,407 | 6/1989 | Bruce et al. | 220/276 |
| 5,042,680 | 8/1991 | Argudo et al. . | |
| 5,145,088 | 9/1992 | Goujon . | |
| 5,617,968 | 4/1997 | Luburic | 220/276 |
| 5,722,562 | 3/1998 | Kick | 220/366.1 X |

FOREIGN PATENT DOCUMENTS

| | | | |
|---|---|---|---|
| 1098217 | 7/1955 | France | 220/101 |
| 6886 | 6/1990 | WIPO | 220/101 |

*Primary Examiner*—Stephen K. Cronin
*Assistant Examiner*—Robin Hylton
*Attorney, Agent, or Firm*—Sixbey, Friedman, Leedom & Ferguson

[57] ABSTRACT

The rectangular reclosable container assembly includes a rectangular open ended container and a closure member for closing the container. The closure member is depressed to engage the inner surface of the container walls, and the container walls and the depressed wall engaging portions of the closure member are provided with cooperating projecting beads and slots which terminate in spaced relationship to the corners of the container and closure member to vent air at the corners of the assembly. The closure member has a tear away skirt which extends from a bridging section which spaces the skirt from the depressed wall engaging portions of the closure member. An upwardly projecting stacking ridge is formed on the closure member to engage the skirt of like closure members and to receive and retain the sidewalls of the container at the bottom thereof to facilitate stacking.

6 Claims, 3 Drawing Sheets

FIG. 1
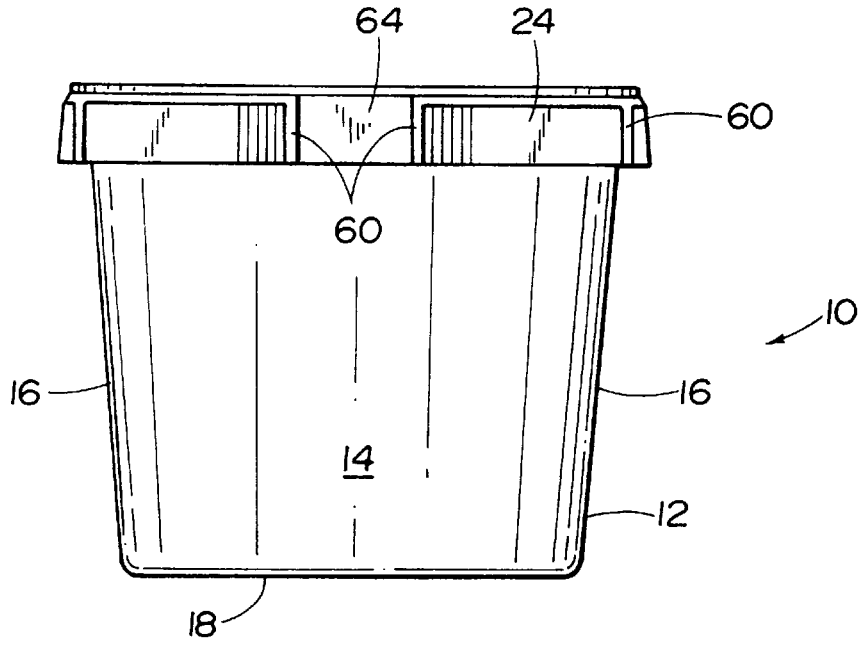
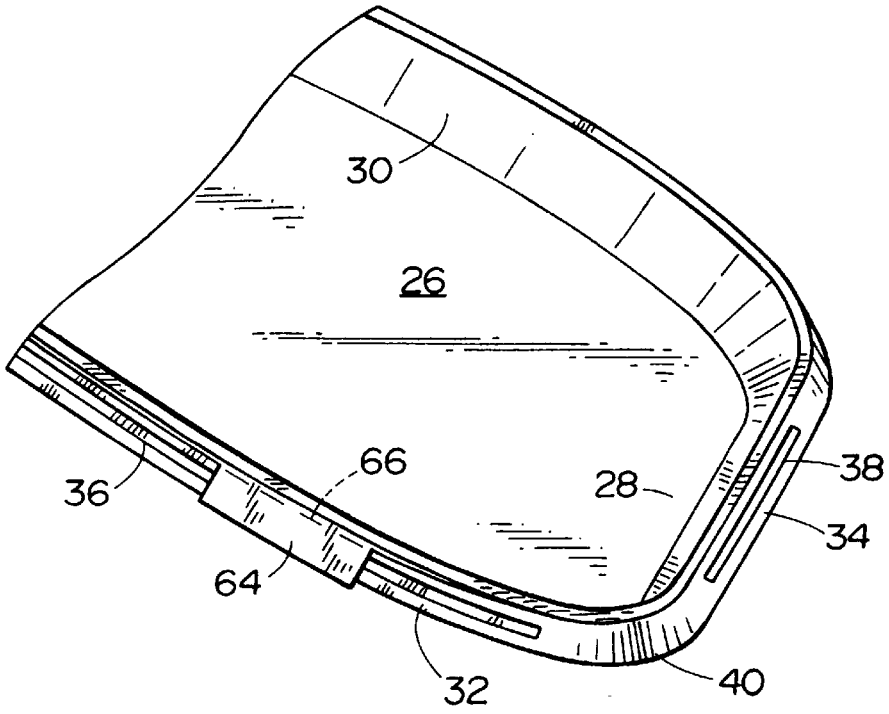
FIG. 2

RECLOSABLE RECTANGULAR CONTAINER ASSEMBLY WITH TAMPER INDICATOR

TECHNICAL FIELD

The present invention relates generally to reclosable container and cap assemblies having a rectangular configuration and more particularly to a rectangular container and cap assembly provided with a tamper indicator.

BACKGROUND OF THE INVENTION

In recent years, it has become important to protect the consumer from unknowingly purchasing a tamper damaged product. Products packaged in reclosable container assemblies are especially vulnerable to tampering because a closure member can be removed in the store and subsequently replaced, thereby concealing the fact that entry to the container has occurred. The problem of undetected entry into a closed reusable container has led to the development of plastic containers and caps for food and other consumable products wherein a plastic closure cap is provided having a tear strip which must be removed the first time the container is opened. With round containers, very effective tamper indicators have been provided on the tear strip to provide an indication when an attempt at tampering is made without removal of the tear strip. U.S. Pat. Nos. 4,682,706 to F. DeVore et al. and 5,042,680 to M. Argudo et al. disclose tamper indicating tear off strips which include a plurality of spaced apart grooves formed in the tear off strip which extend upwardly from the lower edge of the strip and which are bridged by a thin membrane. This membrane tears if an attempt is made to insert an object under the tear off strip.

Many powdered products, such as cocoa and flour, are packaged in substantially rectangular containers having long, curved sidewalls and short straight endwalls joined by arcuate corners. In the past, rectangular containers have been provided with removable lids, as disclosed by U.S. Pat. Nos. 2,941,562 to Ripin and 4,488,676 to Halliday, but these lids are not tamper evident and the container-lid assemblies do not provide features, such as air venting, which are desirable in rectangular containers for powdered food products. Particularly in a plastic container, if a venting system is not provided to equalize pressure in the container with external pressure, the container walls will bulge and may cause a cap seal to rupture.

DISCLOSURE OF THE INVENTION

It is a primary object of the present invention to provide a novel and improved reclosable, rectangular container assembly having a container lid which initially cannot be removed from the container without the removal of a tear strip. However the lid may be tightly reattached to the container and, due to a novel lid and container structure, still provide air vents for material within the container while preventing material from exiting the container.

Another object of the present invention is to provide a novel and improved reclosable rectangular container assembly having a closure lid provided with both a locking tear strip and a tamper indicator which provides apparent and nonconcealable evidence of an attempted or actual entry into the container at any location on the periphery of the container lid. The tear strip includes a plurality of spaced apart grooves which are bridged by a thin, rupturable membrane. The grooves at each corner of the lid are closely spaced while grooves formed along the long sides of the lid are spaced farther apart.

A further object of the present invention is to provide a novel and improved reclosable container assembly having a closure lid formed to both facilitate stacking of the lids for storage and stacking of containers with the lids attached.

A still further object of the present invention is to provide a novel and improved reclosable container assembly having a closure member with a cover section adapted to extend across the open end of a container enclosure but spaced inwardly from the end surface of the container sidewalls. A container engaging section extends from the periphery of the cover section and engages the inner surface, end surface and outer surface of the container sidewalls. The container engaging section has an inner wall for engaging the container sidewalls and endwalls between the cover section and the end surface of the sidewalls and endwalls, an outer skirt spaced from said inner wall for engaging the outer surface of the container sidewalls and endwalls, and a bridging section extending between the inner wall and the outer skirt for engaging the end surface of the container sidewalls and endwalls. The outer skirt is formed to tear away from the bridging section to leave a closure formed from the inner wall, bridging section and cover section.

BRIEF DESCRIPTION OF THE DRAWINGS

FIG. 1 is a view in side elevation of the rectangular reclosable container assembly of the present invention;

FIG. 2 is a perspective view of a portion of the closure member of FIG. 1 with the tear off strip removed;

BEST MODE FOR CARRYING OUT THE INVENTION

Figure 3:
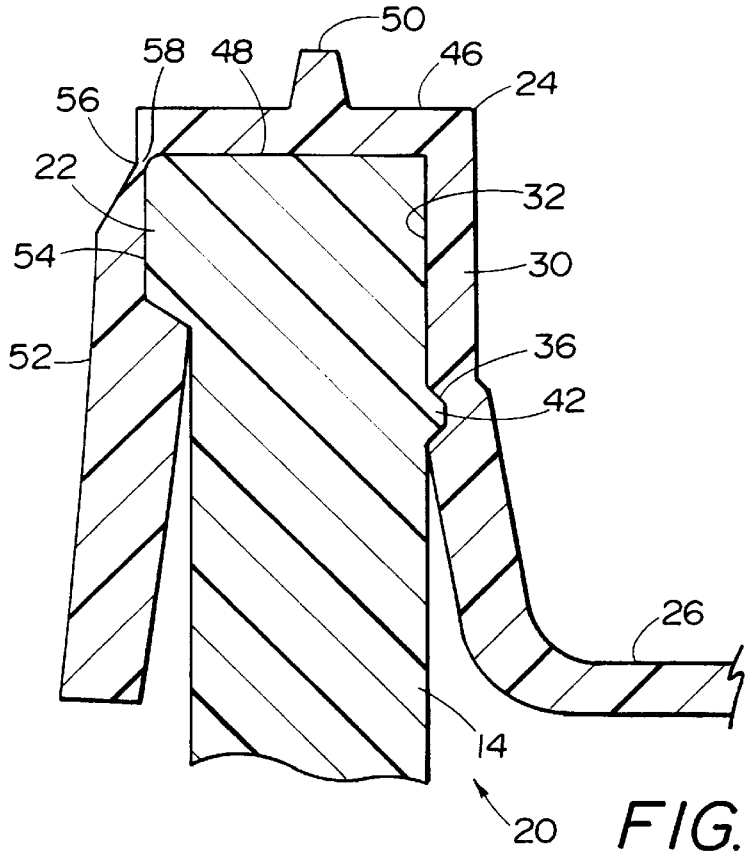
FIG. 3 is a sectional view of a portion of the rectangular reclosable container assembly of FIG. 1.
Figure 4:
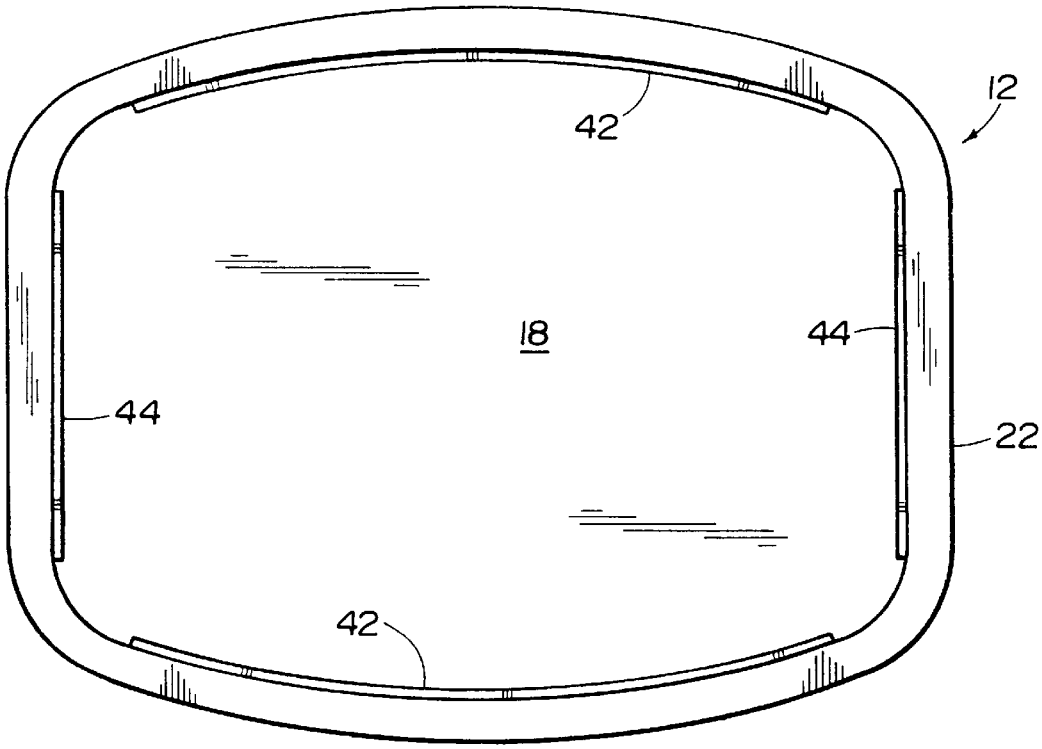
FIG. 4 is a plan view of the top of the container of FIG. 1.

Referring now to the drawings, the reclosable rectangular container assembly with tamper indicator of the present invention indicated generally at 10 includes a substantially rectangular container 12 having spaced, opposed sidewalls 14 joined by spaced opposed endwalls 16. The sidewalls are greater in length than the endwalls and are joined to the endwalls at rounded corners. Sidewalls and endwalls 14 and 16 extend upwardly from a bottom wall 18 to an open end 20 of the container. Formed annularly around the open end of the container on the sidewalls and endwalls is a laterally extending locking lip 22 which provides a locking lip for a container closure member or cap 24.

The container closure member 24 is of unitary construction and includes a cover section 26 for covering the open mouth of the container. The periphery of this cover section is connected to raised cap endwalls 28 and cap sidewalls 30 which engage the endwalls 16 and sidewalls 14 respectively of the container between the cover section and the open end of the container.

The configuration of the two cap endwalls 28 and two cap sidewalls 30 is the same, and is illustrated in FIG. 3 with reference to a sectional view of a portion of the cap sidewall 30. Each of the cap sidewalls 30 includes an outer surface 32 for engaging the inner surface of the adjacent container sidewall, while each cap endwall includes an outer surface 34 for engaging the adjacent surface of the container endwall (FIG. 2). An elongate groove 36 is formed in the outer surface 32 of each of the cap sidewalls and extends lengthwise along the sidewall while an elongate groove 38 is formed in the outer surface 34 of each of the cap endwalls to extend lengthwise along the endwall. The grooves 36 and 38 both terminate in spaced relationship to the corners of the cap where the cap sidewall joins the cap endwall, one of such corners being indicated at 40. The grooves 36 and 38 in the two cap sidewalls and two cap endwalls respectively receive projecting beads or flanges 42 which project inwardly from each container sidewall 14 and projecting beads or flanges 44 which project inwardly from each container endwall 16. Like the elongate grooves 36 and 38, the projecting beads 42 and 44 do not extend around the corners of the container 12. The projecting beads cooperate with the elongate grooves 36 and 38 to permit air to vent at the corners of the container and the container closure.

The container closure 24 includes a top wall or bridging section 46 which extends laterally and outwardly from the cap endwalls 28 and cap sidewalls 30 and which overlies the uppermost edges 48 of the container sidewalls 14 and endwalls 16. This top wall section 46 is formed to provide an upwardly projecting stacking flange or ridge 50 which extends completely around the container closure 24 and which is spaced inwardly from the innermost and outermost edges of the top wall section 46. It will be noted that at the corners of the container, this stacking flange has arcuate sections 51 which extend around the corners of the container closure and are closer to the outermost edge of the top wall section 46 than are the remaining portions of the stacking flange.

A tamper indicator and tear off strip 52 extends downwardly from the outermost edge of the top wall section 46 to engage the outer surfaces of the container sidewalls 14 and endwalls 16. This tamper indicator and tear off strip includes a locking groove 54 formed in the inner surface thereof at the juncture with the top wall section 46 to receive the locking lip 22 and lock the container closure 24 to the container 12. To remove the container closure, the tamper indicator and tear off strip is torn away from the top wall section 46 at the juncture 56 of the tamper indicator and tear off strip with the top wall section. The locking groove 54 thus is formed to reduce the cross sectional area of the tamper indicator and tear off strip at the juncture to a thin, connecting membrane 58 to facilitate the removal thereof.

The tamper indicator and tear off strip 52 is provided with spaced indicator grooves 60 which may be formed in the inner surface, the outer surface, or both the inner and outer surfaces of the indicator and tear off strip. These indicator grooves extend from the bottom of the indicator and tear off strip 52 to the connecting membrane 58, and each indicator groove is bridged by a connecting membrane or web 62. Because the indicator and tear off strip is thin in the area of the indicator grooves, attempts to disengage the indicator and tear off strip from the locking lip 22 will cause the membrane 62 in some indicator grooves to tear and provide visual evidence of tampering.

The container closure member 24 including the tamper indicator and tear off strip 52 is made of resilient plastic and is sized so that when the closure member is locked on the container 12, circumferentially directed tension is established in the indicator and tear off strip so that it cannot be removed without tearing the membrane 62 in one or more indicator grooves. It will be noted in FIG. 5, that two closely spaced indicator grooves 60 are provided at each corner of the closure member. One of these corner indicator grooves is opposite the cap endwall and the remaining corner indicator groove is opposite the cap sidewall. Additional indicator grooves 60 are formed opposite the cap sidewalls and are widely spaced from the corner indicator grooves.

On one side of the closure member 24, the tamper indicator and tear off strip is connected by two indicator grooves 60 to a tab member 64. This tab member is connected to the periphery of the top wall section 46 and is coextensive with the tamper indicator and tear off strip. The tab member has a locking groove section 66 (shown in dotted lines in FIG. 2) which is coextensive with the locking groove 54 to receive the locking lip 22, but this locking groove section is not formed with a connecting membrane 58, so the tab member will remain attached to the top wall section when the tamper indicator and tear off strip is removed as shown in FIG. 2. Opening of the container 12 is accomplished by breaking the membranes 62 in the indicator grooves 60 adjacent to the tab member 64 and then tearing the tamper indicator and tear off strip away from the top wall section 46 along the connecting membrane 58. Then the tab member 64 is lifted upwardly to remove the closure member from the container. To reclose the container, the sidewalls 32 and endwalls 34 are pressed into the open end of the container until the projecting beads 42 and 44 snap into the grooves 36 and 38 and the locking lip 22 snaps into the locking groove section 66. The top wall section 46 now tightly engages the uppermost edges 48 of the container sidewalls and endwalls and retains solid material within the container while permitting air to vent at the corners of the container.

Figure 5:
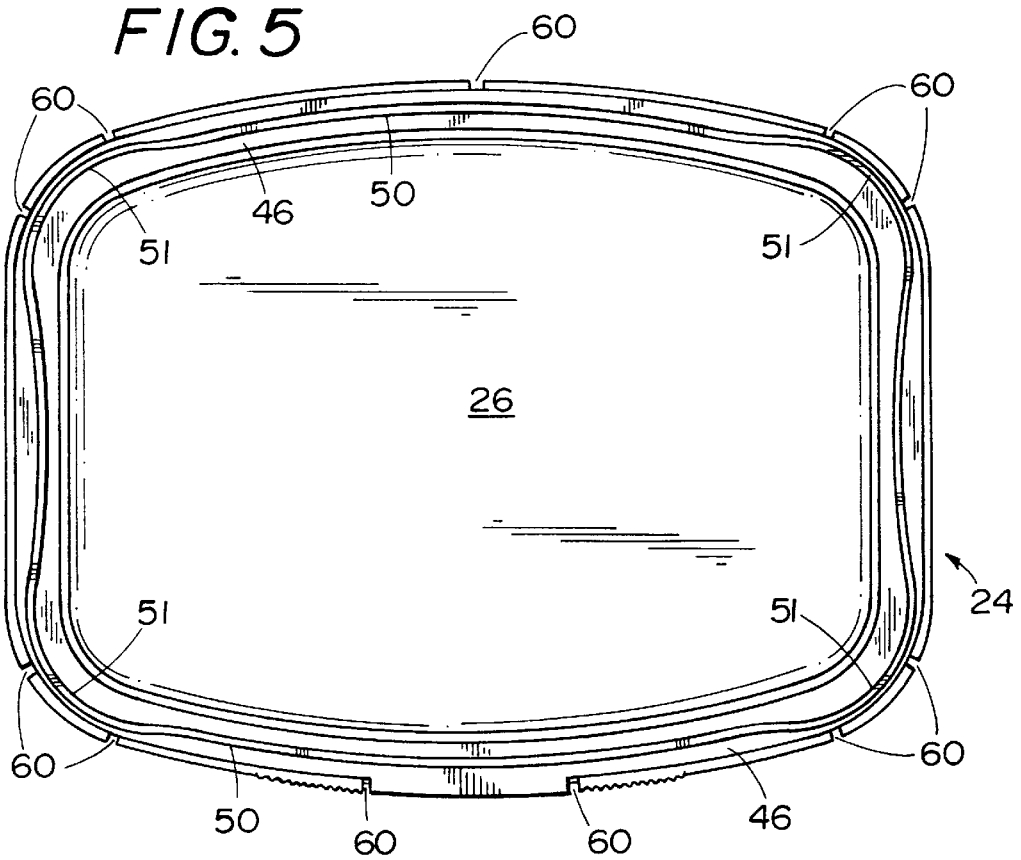
FIG. 5 is a plan view of the top of the closure member of FIG. 1.
Figure 7:
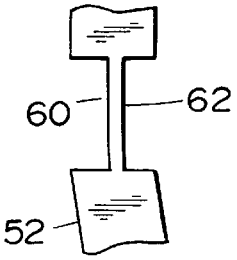
FIG. 7 is a sectional view of a portion of tear off strip of FIG. 1.
Figure 6:
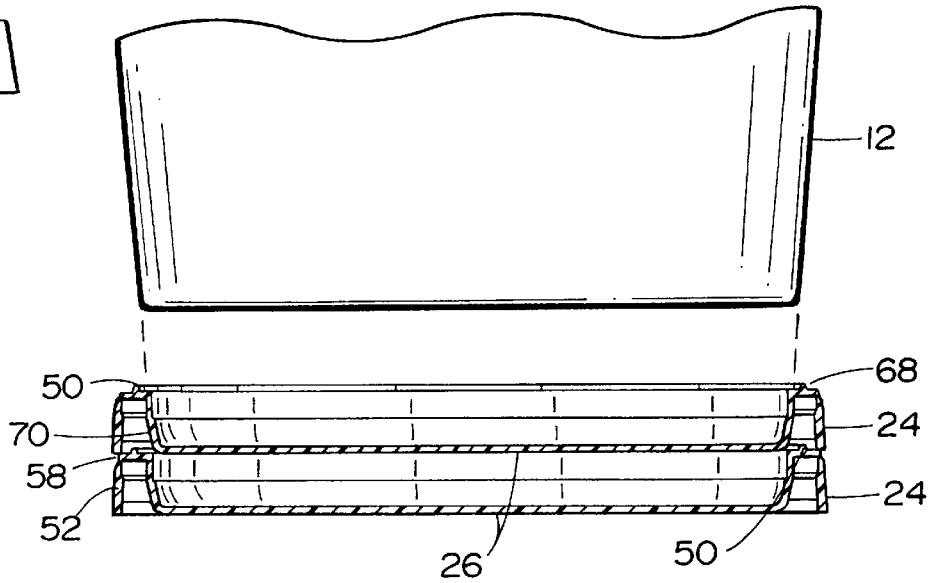
FIG. 6 is a sectional view showing the closure member stacking structure for the rectangular reclosable container assembly of FIG. 1.

With reference to FIGS. 5 and 6, the reclosable rectangular container assembly with tamper indicator 10 is formed to facilitate both the stacking of the closure members 24 as well as stacking of containers capped by these closure members. The stacking flange 50 has an outer surface 68 and an inner surface 70, and is dimensioned such that the inner surface will receive and retain the bottom of the container 12. Thus capped containers may be stacked and are retained against relative lateral movement by the stacking flange 50 on the closure member of the next underlying container.

The stacking flange 50 is also dimensioned to fit between the tamper indicator and tear off strip and the outer surfaces 32 and 34 of the sidewalls and endwalls of similarly formed closure members for stacking. The outer surface 68 of the arcuate sections 51 of the stacking flange engage the inner surface of a closure member tear off strip of an overlying closure member to prevent relative lateral movement of stacked closure members.

INDUSTRIAL APPLICABILITY

The reclosable rectangular container assembly with tamper indicator 10 is effective to provide an indication of tampering before a closure member is initially removed from the container. Subsequently the container closure member retains the contents of the container while venting air from the container interior.

I claim:

1. A rectangular, reclosable container assembly comprising:

a container having two spaced, opposed container sidewalls having an inner and an outer surface, and two spaced, opposed, container endwall having an inner and outer surface, each container endwall being interconnected with said two spaced container sidewalls by arcuately curved container corner sections to form four rounded container corners having an inner and an outer surface, each curved container corner section being joined at a first end to a container sidewall and at a second end to a container endwalls, the container sidewalls, endwalls and rounded container corner sections defining a container open end, said container sidewalls, endwalls and curved corner sections including a laterally projecting locking lip extending outwardly beyond the outer surfaces of said container sidewalls, endwalls and curved container corner sections adjacent to the open end of the container, the container sidewalls, endwalls and curved container corner sections terminating at the open end of the container in end surfaces which extend across said laterally projecting locking lip and around said container open end, elongate projecting beads formed on the inner surfaces of said container sidewalls and endwalls and extending substantially across the extent thereof but terminating at bead ends before said curved container corner sections, said beads being spaced substantially an equal distance inwardly from the open end of said container, and a container bottom wall connected between said container sidewalls, endwalls and curved container corner sections in spaced relation to said container open end, and a closure member mountable on said container for closing the open end of said container, said closure member including a cover section formed to extend across said container below said projecting bead, when the closure member is applied to said container said cover section having a periphery which is adjacent to said container sidewalls, endwalls and curved container corner sections when said closure member is mounted on said container, a container engaging section extending from the periphery of said cover section, said container engaging section having a container engaging wall formed to engage the inner surfaces of said container sidewalls, endwalls and curved container end sections between said cover section and the end surfaces of said container endwalls, sidewalls and curved container corner sections, said container engaging wall having spaced grooves formed therein for receiving the elongate, projecting beads formed on said container sidewalls and endwalls when said closure member is mounted on said container, and a top wall section extending laterally from said container engaging wall in spaced relationship to said cover section and spaced grooves, said top wall section being formed to overlie the laterally projecting locking lip and to engage and overlie the end surfaces of said container sidewalls, endwalls and curved container corner sections when said closure member is mounted on said container, and a tear off strip attached to said topwall section to extend from said top wall section to a tear off strip lower edge in spaced relationship to said container engaging wall and in engagement with said laterally projecting locking lip and the outer surface of said container sidewalls, endwalls and curved container corner sections when said closure member is mounted on said container, said tear off strip including a locking groove at the juncture of said tear off strip with said top wall section to receive said locking flange lip, said locking groove being formed to provide a thin connecting membrane attaching said tear off strip to said top wall section whereby said connecting membrane can be torn to remove said tear off strip from the top wall section, said tear off strip including indicator grooves formed therein with two spaced indicator grooves positioned at each curved corner section of the container when the closure member is mounted on said container, one of said two spaced indicator grooves being formed to extend adjacent to the first end of a curved container corner section and a second of the indicator grooves being formed to extend adjacent to the second end of the curved container corner section with each such indicator groove extending from said tear off strip lower edge to said joinder membrane and inwardly into said tear off strip to a thin, rupturable membrane which bridges said indicator groove.

2. The rectangular, reclosable container assembly of claim 1 wherein at least one nonseparable tab is attached to said top wall section to extend coextensively with said tear off strip, said nonseparable tab being joined to said locking strip by spaced indicator grooves formed on opposite ends of said nonseparable tab, said nonseparable tab having a locking groove section which extends coextensively with said locking groove.

3. The rectangular, reclosable container assembly of claim 2 wherein said top wall section has a lower surface extending to the joinder membrane of said locking groove and an upper surface opposite to said lower surface, said upper surface having an outer edge and an inner edge, and a stacking ridge extending in spaced relationship to the inner and outer edges of said upper surface and projecting upwardly from said upper surface, said stacking ridge having an outer ridge surface for engaging the inner surface of the tear off strip of a similarly formed closure member to facilitate stacking of the closure members.

4. The rectangular, reclosable container assembly of claim 3 wherein said stacking ridge has an inner ridge surface, opposite to said outer ridge surface, said stacking ridge permitting said inner ridge surface to receive and retain the outer surfaces of an identically shaped container having curved corner sections, sidewalls and endwalls adjacent to a bottom wall of said identically shaped container to facilitate stacking of said identically shaped container on said closure member.

5. The rectangular, reclosable container assembly of claim 4 wherein the outer edge of said top wall section of said container engaging section of the closure member is shaped with curved corners joining side and end sections to correspond to the shape of the end surfaces of said container sidewalls, endwalls and curved container corner sections, said stacking ridge being formed to curve closely adjacent to the curved corners of the outer edge of said top wall section and to be spaced further from said outer edge and closer to the inner edge of said top wall section in the area between the curved corners of said outer edge of said top wall section.

6. The rectangular, reclosable container of claim 5 wherein the lower surface of said top wall section is formed to conform in shape to the end surfaces of said container sidewalls, endwalls and curved container corner sections to engage said end surfaces when said closure member is mounted on said container.

* * * * *